United States Patent [19]

Cathcart

[11] 4,170,907

[45] Oct. 16, 1979

[54] DOOR INTERLOCK FOR AN OPEN-HEAD POWER TONG

[75] Inventor: Gregory D. Cathcart, Houston, Tex.

[73] Assignee: Joy Manufacturing Company, Pittsburgh, Pa.

[21] Appl. No.: 901,671

[22] Filed: May 1, 1978

[51] Int. Cl.[2] ..... B25B 17/00

[52] U.S. Cl. ..... 81/57.11; 81/57.15

[58] Field of Search ..... 81/57.15, 57.16, 57.17, 81/57.18, 57.19, 57.2, 57.21, 57.11; 173/2

[56] References Cited

U.S. PATENT DOCUMENTS

| | | | |
|---|---|---|---|
| 2,705,614 | 4/1955 | McKibben et al. | 81/57.16 |
| 3,829,703 | 8/1974 | Wilkie | 173/2 |
| 4,060,014 | 11/1977 | Turner | 81/57.2 |
| 4,095,493 | 6/1978 | Haynes | 81/57.18 |

*Primary Examiner*—James L. Jones, Jr.
*Attorney, Agent, or Firm*—Michael R. Swartz

[57] ABSTRACT

An open-head power tong having an access door is provided with an improved door-interlock mechanism which ensures that the door is closed before the power tong can be operated. The interlock mechanism includes a pneumatically actuated contact valve connected to a pneumatically piloted hydraulic diverter valve which is operably associated with the hydraulic motor that drives the tong. The contact valve is so positioned on the tong such that the door when moved to its closed position engages the contact valve causing the flow of pneumatic pressure to the diverter valve to position the same so as to permit hydraulic fluid to flow to the hydraulic motor for operation of the power tong. When the door is in its open position, out of engagement with the contact valve, the contact valve relieves the pressure on the diverter valve thus positioning the diverter valve to divert the flow of hydraulic fluid around the hydraulic motor whereby the operation of the power tong is stopped.

5 Claims, 3 Drawing Figures

DOOR INTERLOCK FOR AN OPEN-HEAD POWER TONG

BACKGROUND OF THE INVENTION

1. Field of the Invention

The present invention relates to open-head power tongs used in drilling operations, and more particularly, is directed to an improved means of actuating and deactuating the operation of the power tong drive means in response to the opened and closed positions of an access door.

2. Description of the Prior Art

As well known in the drilling industry, power tongs are employed in making-up and breaking-out operations of casings, tubings, rods, pipes and the like. More particularly, power tongs are used to grip and rotate lengths of drill pipe or the like to connect or join several lengths of pipe together to thereby form a drill string in a make-up operation, and in the alternative, to grip and rotate a length of drill pipe to disconnect it from the drill string in a break-out operation.

One type of power tong commonly used today is the open-head tong, such as the one shown and described in U.S. Pat. No. 4,060,014. The open-head tong has a bifrucated frame defining a central opening and a side opening communicating with the central opening for the passing therethrough of a drill pipe or the like. Due to the extreme costs of drilling, open-head tongs have become very popular, in that, they can easily and readily be moved into and out of an operative position when they are needed in the making up and breaking out of drill strings.

In operation, the open-head power tong exerts large rotational torques on the drill pipes, usually the larger the tong, the larger the torque output. Due to these large torque outputs and the resulting forces generated therefrom, the open-head tongs have been provided with an access door that bridges the gap between the bifrucated ends of the tong. The primary purpose of such an access door is to strengthen the tong structure so as to prevent, during the operation of the tong, the bifrucated ends from separating or springing apart, which not only results in damage to the tong, but could also inflict injury to the operating personnel. The access door, in addition to providing structural rigidity to the tong, also provides the operator with safety in bodily protecting him from the rotating pipe gripping and engaging jaws.

Such access doors perform very satisfactorily in providing structural rigidity to the tong and do provide protection to the operators from the rotating components of the tong when the door is properly latched in position during the make-up and break-out operations; however, in an effort to save time, operators have been known to operate the tong with the access door open, and in some instances, the operators have even removed the access door from the tong. Such operator's carelessness not only causes costly structural damage to the tong, but also results in personal injury to the operator.

In U.S. Pat. No. 2,705,614 there is shown an open-head power tong having an automatic hydraulically powered access door, operably interconnected to the hydraulic cylinders that actuate the jaw gripping mechanism, which must be closed before the jaws can be actuated so as to rotate a drill pipe. Such door interlock mechanism has been specifically designed for the type of tong disclosed and is not readily adaptable to other types of power tongs, such as the one shown in the above-mentioned U.S. Pat. No. 4,060,014. Further, the hydraulic circuitry that is involved with such a powered access door is not only complicated, having expensive components, but is also, costly to maintain and repair. Still further, such door interlock mechanism does not provide adequate safety to an operator, in that, although the operator is protected from the pipe gripping and engaging mechanism when the door is closed, he is also subjected to the risk of having the power operated door being automatically swung into him as it is being closed, thus, creating a potentially dangerous and unsafe condition under which the operator must work.

SUMMARY OF THE INVENTION

The present invention obviates the problems experienced with access doors and disadvantages associated with the prior art door-interlock mechanisms by providing, as one of its principle objects, an improved door-interlock mechanism for an open-head power tong that ensures the access door is in a closed position before the tong can be operated, thereby preventing possible structural damage to the tong from operating the tong with the door open, as well as, preventing personal injury to the operators by protecting them from the various rotating components of the tong.

Another object of the present invention is to provide a door-interlock mechanism for an open-head power tong that is simple in structure and adaptable to all types of open-head power tongs.

Still another object, is to provide a door-interlock mechanism for an open-head power tong that is easily repaired and inexpensive to maintain.

Accordingly, the present invention, sets forth in an open-head power tong having an access door mounted on the tong and moveable between opened and closed positions, an improved door-interlock mechanism that includes means for controlling the operation of the tong in response to the opened and closed position of the door. More particularly, the control means preferably includes a pneumatic contact valve interconnected with a pneumatically piloted diverter valve operably associated with the power means of the tong such that the power means is placed in either an operative or inoperative condition in response to respective closed and opened positions of the door. Specifically, the pneumatic contact valve is so positioned in the vicinity of the side opening that the door, in its closed position, engages the contact valve thereby actuating the diverter valve to permit operation of the power means, and when, the door is moved from its closed position out of engagement with the contact valve, the contact valve causes the diverter valve to deactuate the power means, thus stopping the operation thereof.

These and other advantages and attainments of the present invention will become apparent to those skilled in the art upon reading of the following detailed description when taken in conjunction with the drawings wherein there is shown and described an illustrative embodiment of the invention.

BRIEF DESCRIPTION OF THE DRAWINGS

In the course of the following detailed description, reference will be frequently made to the attached drawings in which.

DETAILED DESCRIPTION OF THE INVENTION

Figure 1:
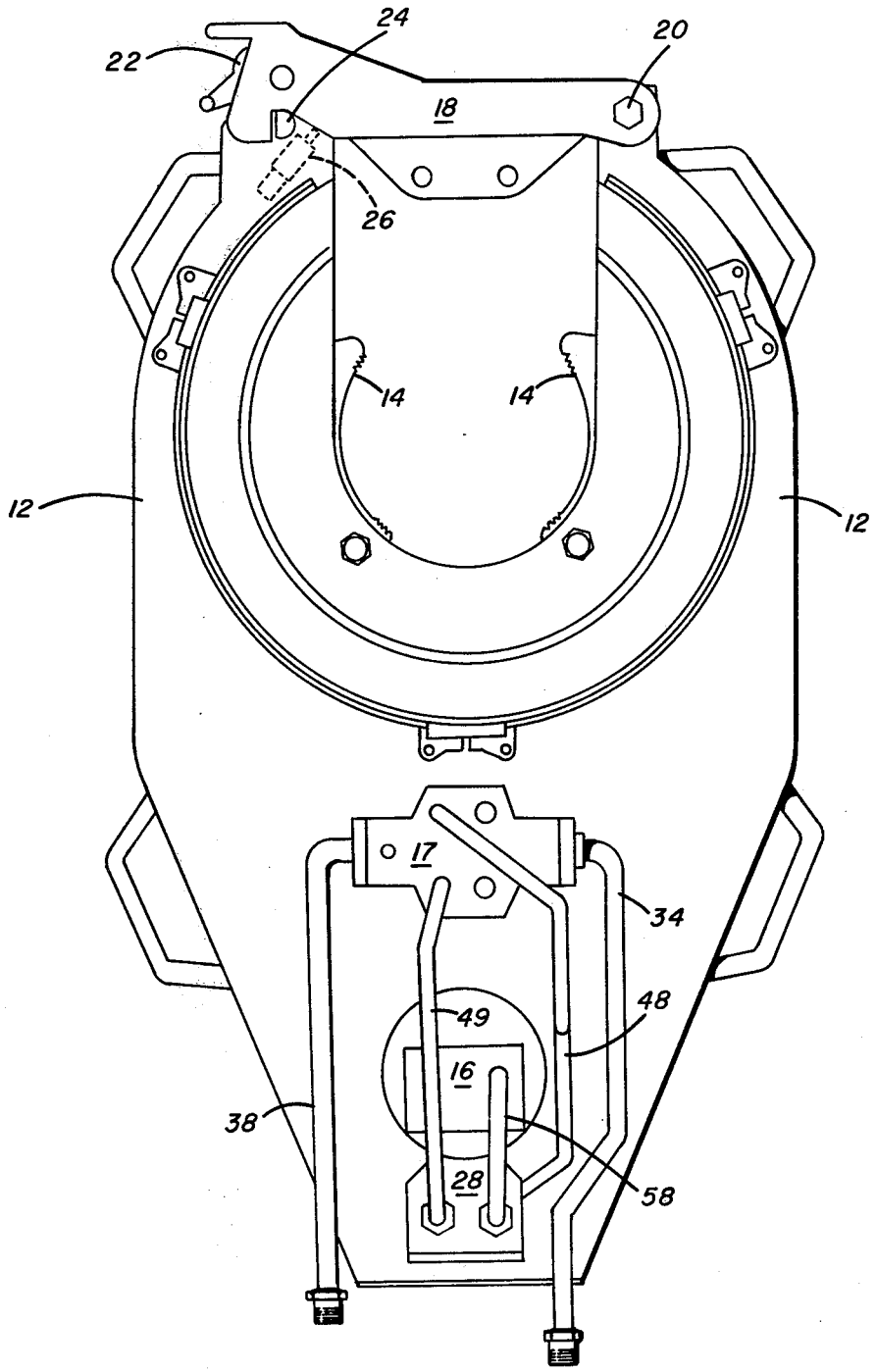
FIG. 1 is a top plan view of an open-head power tong incorporating the improved door-interlock mechanism of the present invention with the access door being in its closed position in engagement with the contact valve which actuates the diverter valve.

Referring to the drawings, and particularly, to FIG. 1, there is shown, for illustration purposes only, an open-head power tong, being generally indicated by the numeral 10, incorporating the principles of the present invention. The tong illustrated in FIG. 1 is of the type shown and described in U.S. Pat. No. 4,060,014, and thus, for the sake of brevity, since the tong itself forms no part of this invention, only a brief description of the tong will follow.

Briefly, as best seen in FIG. 1, the power tong 10 is comprised of a bifrucated frame structure 12 defining a central drill pipe receiving opening, and a side opening that communicates to the central opening for laterally passing a drill pipe therewithin. Rotatably supported within the frame structure 12 is a pipe engaging and gripping means that includes jaws 14 that swing into and out of the central opening for gripping and rotating a drill pipe disposed within the central opening during make-up and break-out operations of a drill string. The pipe engaging and gripping means with its associated jaws 14 are rotatably driven through a suitable drive train (not shown) by power means such as the hydraulic motor 16 which receives fluid under pressure from a suitable hydraulic pump (not shown) and through a hydraulic control valve 17. The valve 17 is conventional, being moveable between three spool positions; one position being such that the fluid drives the motor in a forward clockwise direction, another position being such that the hydraulic fluid drives the motor in a reverse counterclockwise direction, and the third position being a neutral position wherein fluid passes through the valve to the return line that returns the fluid to a reservoir (not shown) for recirculation thereof.

Also supported on the frame structure 12 is an access door 18, adapted to span or bridge the access opening defined between the bifrucated end portions so as to provide structural rigidity to the power tong 10, as well as, to protect the operator from the various moving components, such as the jaws 14. One end of the access door 18 is hinged to an end of one of the frame bifrucations by a pivot pin 20 whereas the free end of the door is provided with a self-latching arm 22 that engages a latch member 24 mounted on the other bifrucation so as to positively latch the door when it is closed. The door and the door latching mechanism are of the type shown and described in a pending U.S. application, bearing U.S. Ser. No. 791,752; filed Apr. 28, 1977; and entitled TONG LOCKING MECHANISM. The door and the latching mechanism forms no part of this invention and thus a further description will not be given.

To ensure that the tong 10 is only operated when the door 18 is closed, closing the access opening, the tong 10 is provided with an interlock mechanism which basically includes a contact valve 26, engageable by the door 18, and a hydraulic diverter valve 28, operably associated with the hydraulic motor 16 so as to permit flow of hydraulic fluid to the motor, or, in the alternative position, to bypass the flow of hydraulic fluid around the motor.

Figure 2:
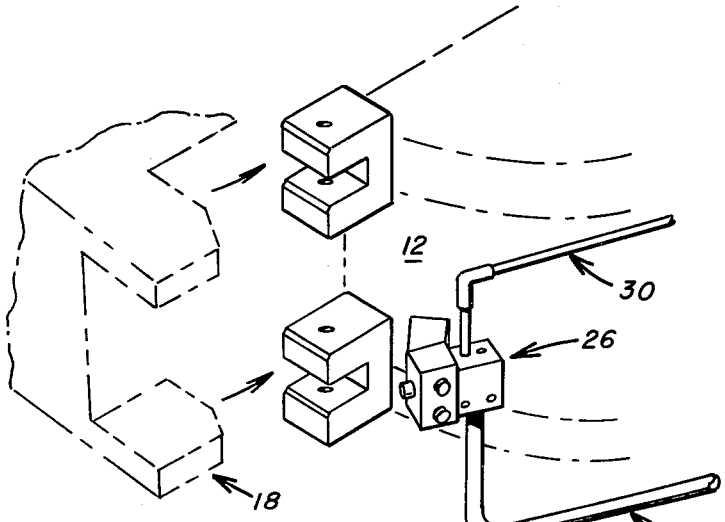
FIG. 2 is a diagrammatic fragmentary view of the power tong showing the side edge portion of the access door with the door latch removed and with the contact valve being in disengagement with the door which is partly open.

As seen in FIGS. 1 and 2, in particularly FIG. 2, the contact valve 26 is mounted on the front side of the frame structure 12, in proximity to the access opening, and is so positioned to be engaged by the door 18 when the door is closed and disengaged when the door is opened. The contact valve 26 has an internal spring that biases the valve to its disengaged position. A suitable source for generating pneumatic pressure, such as a compressor (not shown) is provided to supply pressure to the valve 26 through inlet line 30 and therethrough, when valve 26 is in its engaged position, via line 62 to one end of the pneumatic piloted hydraulic diverter valve 28. When pressure is so applied on the diverter valve 28, the valve is so positioned to permit hydraulic fluid to flow to the motor 16 and thereby its operation. However, when pressure is relieved from the diverter valve 28, which is caused when the door 18 is disengaged from the contact valve 26, an internal biasing spring forces the valve to a position which diverts the flow of hydraulic flow around the motor 16, and thus, stoppage thereof.

Figure 3:
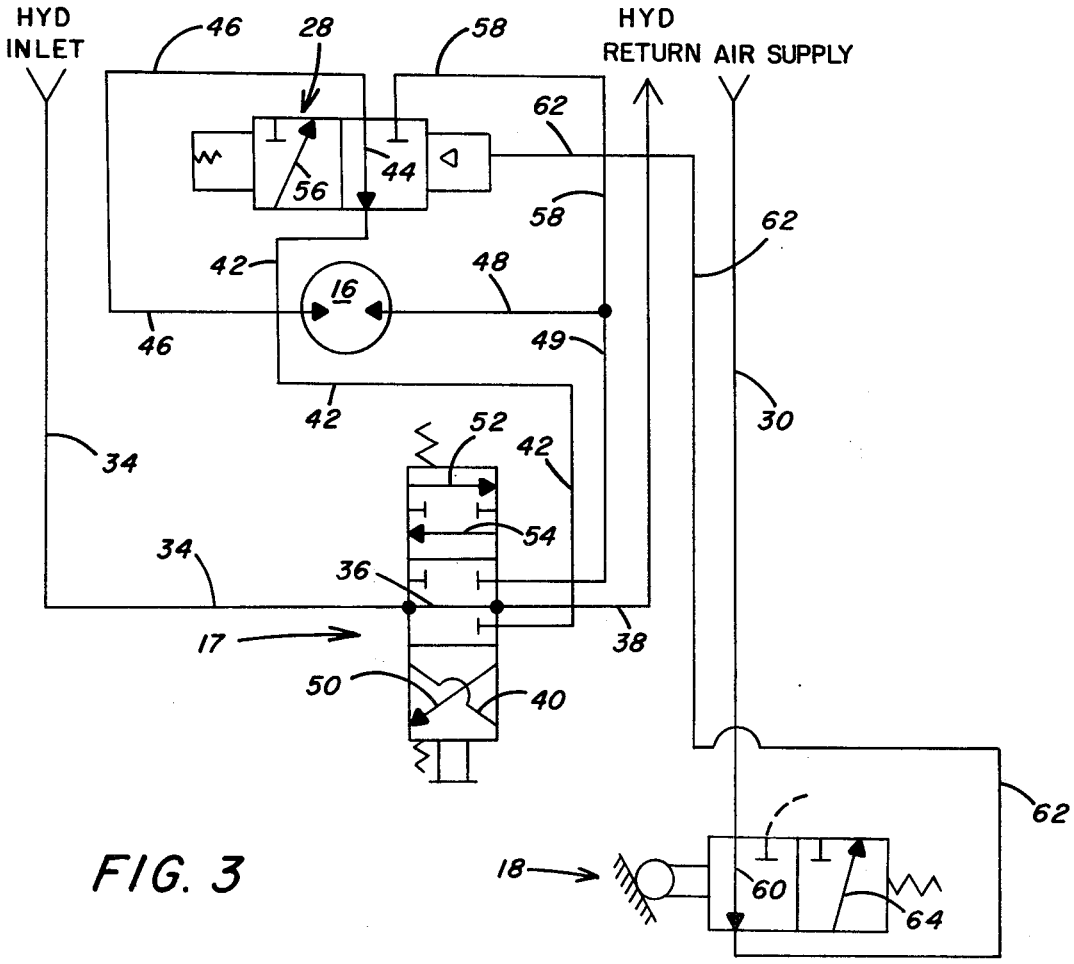
FIG. 3 is a schematic representation of the hydraulic and pneumatic circuitry associated with the tong.

Now turning to FIG. 3 which schematically represents the various operating components as well as the hydraulic and pneumatic circuitry associated therewith, the operation of the door interlock will be further described. First, it should be noted that both the hydraulic source and the pneumatic source are fully operating with respective fluids being under pressure in inlet lines, the access door 18 being closed, engaged with the actuating arm of the contact valve 26, the piloted diverter valve 28 being detented so as to pass the flow of hydraulic fluid around the motor 16, and with the hydraulic spool control valve 17 being in its neutral position such that fluid passes directly therethrough to the reservoir tank via inlet line 34, passageway 36, return line 38. Thus, as the spool valve 17 is shifted to its forward drive position, hydraulic fluid passes from the inlet line 34, through passageway 40, to line 42, through passageway 44 (of diverter valve 28), to line 46 which directs fluid into the left-hand side of the motor 16, and then via lines 48,49 to passageway 50 of valve 18 which is internally connected to the hydraulic return line 38. If the spool valve 17 is shifted in an opposite direction so as to reverse the direction of the motor 16, fluid flows via line 34, through passageway 52 to line 49 and line 48 to the right side of the motor 16, and then returns via lines 46, passageway 44, line 42 to passageway 54 which is internally connected to return line 38. It can be thus seen that when pressure is applied on the diverter valve 28, it is so positioned to pass hydraulic fluid either to one or the other sides of the motor 16 to thereby drive the rotating components of the tong 10 in either forward or reverse directions depending on the forward or reverse positions of the control valve 17. However, when the pneumatic pressure is relieved from the diverter valve 28, the internal spring forces the valve to the right, thus changing the flow path of the hydraulic fluid so as to bypass the motor 16. In such pressure relief position of the diverter valve 28, the fluid flow path is via lines 49,58, passageway 56 and line 42, thereby bypassing the flow of fluid to the motor 16. Since the flow of fluid through line 46 is blocked, no fluid passes to the motor 16, thus rendering it inoperative.

Thus, it can be readily appreciated from the above, that hydraulic fluid is either directed to the motor 16 for operation thereof, or bypassed therearound, preventing its operation, depending on the position of diverter valve 28. The diverter valve 28 is caused to move between its respective positions in response to the engaged and disengaged positions of the contact valve 26. In its engaged position, air under pressure passes from inlet line 30 through passageway 60 to line 62 for applying pressure to the diverter valve 28 to thereby maintain it in its retracted position wherein hydraulic fluid is permitted to pass to the motor 16. However, when the access door 18 is opened, disengaged from the contact arm of the contact valve 26, the internal spring in the contact valve 26 moves the valve to the left, thereby relieving the pressure in line 62 by venting it to the atmosphere through passageway 64, causing the internal spring to shift the position of the diverter valve 28 such that hydraulic fluid flow is bypassed around the motor 16, thus non-operation thereof.

It can be understood from the foregoing that the described interlock-mechanism controls the operation of the hydraulic motor 16, and thus the operation of the tong 10, in response to the open and closed positions of the access door 18, such that the tong 10 can only be operated with the access door 18 in its closed position, and thereby eliminating the possibility of structural damage to the tong from operating same with the door open, as well as, providing safety to the operator from exposure to the various operating components of the tong.

It is thought that the invention and many of its attendant advantages will be understood from the foregoing description and it will be apparent that various changes may be made in form, construction, and arrangement of the improved door interlock mechanism without departing from the spirit and scope of the invention or sacrificing all of its material advantages, the form hereinabove described being merely a preferred or exemplary embodiment thereof.

Having thus described the invention, what is claimed is:

1. In a power tong for use in make-up or break-out of a drill pipe or the like in drilling operations including a bifrucated frame structure having a central opening and a side opening which communicates with said central opening, drill pipe engaging and gripping means rotatably supported for movement into and out of said central opening, power means operably associated with said drill pipe engaging and gripping means for rotating said drill pipe about the axis of said central opening, and a door mounted on said frame structure in proximity to said side opening and moveable between a closed position to close said side opening during operation of said power tong and an open position to open said side opening to permit a drill pipe to pass therethrough to said central opening, an improved door-interlock mechanism for ensuring said door is in its closed position during operation of said power means, thereby providing safety to the operating personnel as well as protecting the tong from possible damage which may occur in operating the tong while the door is open, said improved door-interlock mechanism comprising:

means on said frame structure for controlling the operation of said power means in response to the closed position of said door wherein said door engages said control means and the opened position of said door wherein said door is disengaged with said control means, said control means actuating said power means when said door is in its closed engaged position and deactuating said power means when said door is in its open disengaged position.

2. The improved door-interlock mechanism as described in claim 1, wherein said control means includes:

(a) a first portion mounted in the vicinity of said side opening and respectively engageable and disengageable with said door as said door is moved between its closed and opened positions; and (b) a second operably associated with said power means to actuate and deactuate same;

(c) said first portion pneumatically controls said second portion to actuate said power means when said door is engaged with said first portion in its closed position and deactuates said power means when said door is disengaged from said first portion in its opened position.

3. The improved door interlock mechanism as described in claim 2, wherein said first portion is a valve having a plunger for engagement and disengagement with said door, said power means is a hydraulic motor, and said second portion is a pneumatically actuated valve which hydraulically controls the operation of said hydraulic motor.

4. In a power tong for use in make-up and break-out of drill pipe or the like in drilling operations including a bifrucated frame structure having a central opening and a side opening which communicated with said central opening, drill pipe engaging and gripping means rotatably supported for movement into and out of said central opening, power means operably associated with said drill pipe engaging and gripping means for rotating said drill pipe about the axis of said central opening, and a door mounted on said bifrucated frame structure in proximity to said side opening and moveable between a closed position to close said side opening during operation of said power tong and an opened position to open said side opening to permit a drill pipe to pass therethrough to said central opening, an improved door-interlock mechanism for ensuring said door is in its closed position during operation of said power means in thus providing safety to the operating personnel and preventing the possibility of damage to the tong from operating same with said door open, said improved door-interlock mechanism comprising:

(a) a source of pneumatic pressure;

(b) a pneumatically actuated control means for controlling the operation of said power means; and (c) contact means engageable and disengageable with said door, said contact means providing communication of pneumatic pressure from said source to said control means when engaged by said door and relief of pneumatic pressure on said control means when disengaged by said door, said control means in response to communication of said pneumatic pressure causing operation of said power means and in response to relief of said pneumatic pressure causing termination of the operation of said power means.

5. The improved door-interlock mechanism as described in claim 4, wherein said power means is a hydraulic motor, said control means is a moveable hydraulic valve for controlling the flow of hydraulic flow to and bypassing around said hydraulic motor, and said contact means is a moveable valve having a plunger engageable and disengeable by said door.

* * * * *

UNITED STATES PATENT OFFICE

CERTIFICATE OF CORRECTION

PATENT NO. : 4,170,907

DATED : October 16, 1979

INVENTOR(S) : Gregory D. Cathcart

It is certified that error appears in the above-identified patent and that said Letters Patent are hereby corrected as shown below:

Correct the spelling of the word "bifurcated" as it appears in:

Column 1, line 26
Column 1, line 40
Column 1, line 43
Column 3, line 26
Column 3, line 51
Column 5, line 45
Column 6, line 29
Column 6, line 36

Column 3, line 55 delete "bifrucations" and insert --bifurcations--.

Column 3, line 58 delete "bifrucation" and insert --bifurcation--.

Column 6, line 12 after the word "second" insert --portion--.

Signed and Sealed this

*Eighth* Day of *January 1980*

[SEAL]

*Attest:*

SIDNEY A. DIAMOND

*Attesting Officer*

*Commissioner of Patents and Trademarks*